US008205360B1

(12) United States Patent
Vanneman et al.

(10) Patent No.: US 8,205,360 B1
(45) Date of Patent: Jun. 26, 2012

(54) SNOWPLOW LASER GUIDANCE SYSTEM

(75) Inventors: Robert W. Vanneman, Bend, OR (US); Cecil E. Rench, Sultan, WA (US)

(73) Assignee: LaserLine Mfg., Inc., Redmond, OR (US)

( * ) Notice: Subject to any disclaimer, the term of this patent is extended or adjusted under 35 U.S.C. 154(b) by 0 days.

(21) Appl. No.: 13/111,758

(22) Filed: May 19, 2011

Related U.S. Application Data

(63) Continuation of application No. 11/650,236, filed on Jan. 5, 2007, now Pat. No. 7,966,753.

(60) Provisional application No. 60/757,728, filed on Jan. 9, 2006.

(51) Int. Cl.
*B62D 11/02* (2006.01)
*E01H 5/00* (2006.01)

(52) U.S. Cl. ..... 37/196; 340/435

(58) Field of Classification Search ..... 37/219–236, 37/348, 196, 241; 172/2–11; 372/55, 57, 372/94; 404/113–118; 340/686.1, 932.2, 340/942, 435, 438, 436, 425.5
See application file for complete search history.

(56) References Cited

U.S. PATENT DOCUMENTS 3,727,332 A 4/1973 Zimmer
4,768,958 A 9/1988 Suddaby
4,978,246 A 12/1990 Quenzi et al.
5,052,854 A 10/1991 Correa et al.
5,387,853 A 2/1995 Ono
5,390,118 A 2/1995 Margolis et al.
5,505,000 A * 4/1996 Cooke ..... 33/286
5,875,408 A 2/1999 Bendett et al.
6,108,031 A 8/2000 King et al.
6,184,800 B1 2/2001 Lewis
6,198,386 B1 3/2001 White, II
6,203,112 B1 3/2001 Cook et al.
6,464,380 B1 * 10/2002 Young, Jr. ..... 362/485
6,736,216 B2 5/2004 Savard et al.
6,743,089 B2 6/2004 Driller
6,883,947 B1 4/2005 Sarabia
6,900,425 B1 5/2005 Aliev et al.
6,900,724 B2 5/2005 Johnson
6,946,973 B1 9/2005 Yanda
(Continued)

OTHER PUBLICATIONS

David C. Slaughter et al., *Vision-based Low Cost Field Demonstrable Paint Restriping Guidance System*, <www.ahmct.ucdavis.edu/images/UCD_ARR_01_09_14_02.pdf>, Feb. 2002 (62 pages).

*Primary Examiner* — Robert Pezzuto
(74) *Attorney, Agent, or Firm* — Perkins Coie LLP

(57) ABSTRACT

A snowplow laser guidance system is disclosed. The system can include, for example, a laser light source, a laser exit window through which a laser beam generated by the laser light source is transmitted, and a pressurized gas conduit. The pressurized gas conduit can have an opening positioned such that gas released through the opening flows across a face of the laser exit window. This can be useful to remove accumulated material, such as snow, ice, water, and dirt. The gas can be, for example, pressurized gas from a pressurized gas source of a snowplow vehicle. Release of pressurized gas across the face of the laser exit window can occur at a programmed frequency and/or in response to an operator signal, such as a signal from a switch on a control panel. The system also can include a heater connected to the laser exit window for defrosting.

13 Claims, 4 Drawing Sheets

U.S. PATENT DOCUMENTS 7,195,423 B2 3/2007 Halonen et al.
7,293,923 B2 * 11/2007 Tung ..... 385/93
7,573,921 B2 8/2009 Yumoto et al.
7,630,424 B2 12/2009 Ershov et al.
7,966,753 B2 * 6/2011 Vanneman et al. ..... 37/196
2003/0107900 A1 6/2003 Ellison
2007/0157490 A1 7/2007 Vanneman et al.

* cited by examiner

SNOWPLOW LASER GUIDANCE SYSTEM

CROSS REFERENCE TO RELATED APPLICATIONS

This is a continuation application based on prior U.S. patent application Ser. No. 11/650,236, filed Jan. 5, 2007, now issued as U.S. Pat. No. 7,966,753, which claims the benefit of the earlier filing date of prior U.S. Provisional Application No. 60/757,728, filed Jan. 9, 2006. The prior applications are incorporated herein by this reference.

FIELD

This disclosure relates generally, inter alia, to laser guidance systems, particularly laser guidance systems for vehicles.

BACKGROUND

Snowplows are used extensively to remove accumulated snow from roads and other surfaces. Many modern snowplows include a wing plow blade attached to one side of the snowplow vehicle. Wing plow blades typically are used to further displace snow directed to one side of the vehicle by a main plow blade attached to the front of the vehicle. Incorporating a wing plow blade increases the amount of snow that can be cleared by a single vehicle. Since wing plow blades typically are positioned behind the operator's field of vision, it can be difficult for the operator to know where the edge of the wing plow blade is located during operation of the vehicle. Thus, operators often are forced to overcompensate for clearance of the wing plow blade or risk a collision between the wing plow blade and an adjacent object, such as a curb or a parked vehicle.

SUMMARY

Described herein are, inter alia, embodiments of a snowplow laser guidance system. These embodiments can include, for example, a laser light source (e.g., a DC-powered laser light source), a laser exit window through which a laser beam generated by the laser light source is transmitted, and a pressurized gas conduit. The pressurized gas conduit can have an opening (e.g., the opening of an adjustable nozzle) positioned such that gas released through the opening flows across a face of the laser exit window. The system can be configured to direct gas through the pressurized gas conduit and across the face of the laser exit window, for example, at a programmed frequency or both at a programmed frequency and in response to an operator signal. The pressurized gas conduit can include a pneumatic hose, such as a pneumatic hose connected to a pressurized gas source of a snowplow vehicle. In some embodiments, the system includes a control module with a switch configured to cause gas to be directed through the pressurized gas conduit and across the face of the laser exit window.

The system can include a snowplow vehicle to which the laser light source is connected. The laser light source can be contained within a laser housing and the system can include a bracket configured to mount the laser housing to the snowplow vehicle. For example, the laser housing can be mounted to the snowplow vehicle such that the laser housing is rotatable in a first plane. In addition, the laser housing and the bracket can be rotatable in a second plane substantially perpendicular to the first plane. The laser light source can be positioned relative to the snowplow vehicle so as to generate a visible indicator of a future position of an edge of a snowplow blade, such as a wing plow blade. For example, the laser light source can be positioned relative to the snowplow vehicle so as to generate a visible indicator between about 20 feet and about 100 feet in front of the snowplow vehicle and to one side of the snowplow vehicle at least the width of the snowplow vehicle's wing plow blade.

In some embodiments, the system includes a heater (e.g., a resistive heater) connected to the laser exit window. These and other embodiments also can include a temperature gauge. For example, the temperature gauge can be a thermistor sensor also used to control an operating temperature of the laser light source. When a temperature detected by the temperature gauge is less than a predetermined temperature, a signal can be sent to activate the heater.

Also described herein are, inter alia, embodiments of a method for guiding a snowplow. These embodiments can include directing a laser beam onto a surface to generate a visible indicator of a future position of an edge of a snowplow blade (e.g., a wing plow blade) and guiding a snowplow vehicle based on a location of the visible indicator. The laser beam can be generated by a laser light source within a laser housing, which can be attached to a snowplow vehicle. Some embodiments include heating the output window of the laser housing. These and other embodiments also can include directing gas from a pressurized gas conduit across a face of the exit window of the laser housing, such as after directing gas from a pressurized gas source of the snowplow vehicle to the pressurized gas conduit.

DETAILED DESCRIPTION

Figure 1:
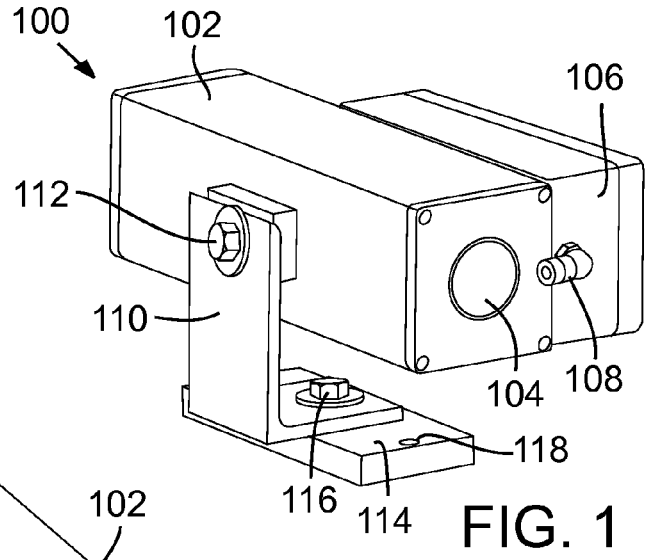
FIG. 1 is a front perspective view of one embodiment of a laser module for use with some embodiments of the disclosed laser guidance system.

Disclosed herein are, inter alia, embodiments of a snowplow laser guidance system, embodiments of components of a snowplow laser guidance system, and embodiments of a method for guiding a snowplow. Throughout this disclosure, the singular terms "a," "an," and "the" include plural referents unless the context clearly indicates otherwise. Similarly, the word "or" is intended to include "and" unless the context clearly indicates otherwise. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Embodiments of the disclosed snowplow laser guidance system typically include a laser module that projects a laser beam to a point in front of a snowplow vehicle representing a future position of an outside edge of a snowplow blade. The projected point typically is within the operator's field of vision. Particularly when the operator cannot see the outside edge of the snowplow blade, the point can serve as a useful reference to aid in guidance of the snowplow vehicle. Use of the laser guidance system can prevent accidents that cause property damage and equipment downtime.

Many conventional snowplows include a main plow blade positioned on the front of a vehicle and a wing plow blade positioned on one or both sides of the vehicle. The disclosed laser guidance system can be used to facilitate guidance of any of various types of snowplow blades, including main plow blades and wing plow blades. The system is particularly useful for guidance of wing plow blades, however, because the outside edge of these blades typically is outside the operator's field of vision.

The disclosed laser guidance system can include a variety of laser types. Exemplary laser colors include red and green, both of which have good visibility on snow, asphalt, and other surfaces. In some embodiments, the laser generates less than 5 milliwatts of laser light. The laser typically complies with C.F.R. §21-1040 and meets all OSHA and other federal standards for operation.

Some embodiments of the disclosed laser guidance system include one or more components for preventing laser obstruction. Obstruction of the laser can be caused, for example, by frosting and/or the buildup of material (e.g., snow, ice, water, and dirt) on the exit window through which the laser beam is transmitted. Such obstructions are common in the weather conditions in which snowplows operate. Furthermore, the laser typically should not be mounted inside the cab because the windshield can interfere with the laser beam and/or cause a dangerous reflection into the operator's eyes.

The laser exit window can be defrosted, such as by heating. For example, the laser exit window can include a resistive heater. In some embodiments, the laser exit window is heated with 17 watts of resistive heating when the internal temperature is below a set point, such as about 26° C. The temperature can be measured indirectly using the laser's thermistor sensor.

The system also can include a component, such as a wiper blade, for physically removing material from the laser exit window. For example, some embodiments include a component that directs liquid and/or gas across the face of the laser exit window. In some implementations, components that direct air across the face of the laser exit window are preferred. The use of pressurized air has several advantages. First, air is substantially transparent to visible wavelengths of light and, therefore, does not substantially block the laser beam. Second, air is gentle and typically will not damage the laser exit window. Other methods can cause scratching of the laser exit window, which can alter its optical characteristics. Third, pressurized air typically is available from other systems on conventional snowplow vehicles (e.g., pneumatic control systems and braking systems). Thus, most conventional snowplow vehicles include a secondary air source that can be used to supply pressurized air to the laser guidance system.

The disclosed components for removal of material from the laser exit window can be configured to remove material at regular time intervals. For example, an electrically controlled air solenoid valve can be energized at a regular interval. The components can be configured to direct an air stream across the face of the laser exit window for a set amount of time and then stop the air stream for a set amount of time. In some embodiments, the air stream is on for between about 0.1 seconds and about 2 seconds, such as between about 0.2 seconds and about 1 second or between about 0.3 seconds and about 0.7 seconds. In working embodiments, the air stream was on for 0.5 seconds. The active time period can be followed by a standby time period. The standby time period can be, for example, between about 5 seconds and about 2 minutes, such as between about 10 seconds and about 1 minute or between about 15 seconds and about 30 seconds. In working embodiments, the air stream was configured to be in standby mode for 15 or 30 seconds. The duration of the active and standby time periods can be adjustable, for example, by a dial on the control panel. This may be useful to allow an operator to achieve a degree of material removal appropriate for the weather conditions (e.g., temperature, humidity, precipitation, etc.). A manual override switch also can be included to override the programmed time intervals and direct air across the face of the exit window on demand, such as for occasional extra material removal.

Some disclosed embodiments include both a heated exit window and a device for removing material from the laser exit window. The combination of these features can be particularly useful, with the former serving primarily to prevent frosting and the latter serving primarily to remove accumulated material. One example of a laser guidance system kit includes a laser housing, a pneumatic air release module, an in-cab control panel, an interconnect cable for connecting the laser housing to the in-cab control panel, a DC cable for connecting the system to the snowplow's DC power (e.g., 12V), and a pneumatic hose line for connecting the pneumatic air release module to the snowplow's secondary air source. The laser housing can include an optic plate mounting platform, a microprocessor or electronics, a laser, a laser mounting assembly, a laser driver board, and an automatic cooling and heating system.

Figure 2:
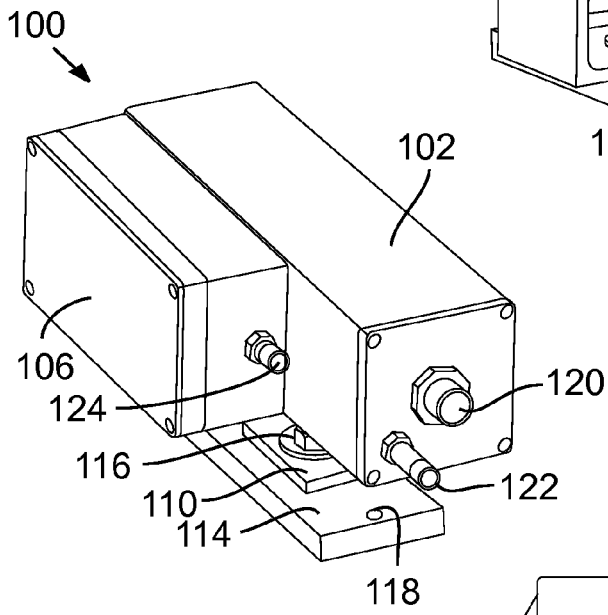
FIG. 2 is a rear perspective view of the laser module shown in FIG. 1.

Some embodiments of the disclosed laser system are illustrated in the accompanying figures. FIGS. 1 and 2 are front and rear perspective views, respectively, of one embodiment of a laser module. The illustrated laser module 100 includes a laser (not shown) contained in a housing 102. The housing 102 includes a heated exit window 104 through which a laser beam generated by the laser can be transmitted. The housing 102 can be specially designed for the harsh, winter conditions encountered during typical snowplow operation. In some embodiments, the housing 102 is weatherproof, hermetically sealed, and/or dry nitrogen charged. The laser module 100 also includes a pneumatic air release module 106 positioned to direct air across the face of the exit window 104. The air is delivered through an adjustable air delivery nozzle 108.

In the illustrated embodiment, the housing 102 is attached to a first wing of a mounting bracket 110 with a first bolt 112. A second wing of the mounting bracket 110 is attached to a mounting plate 114 with a second bolt 116. The mounting plate 114 includes mounting holes 118 for attaching the laser module 100 to a snowplow vehicle. The first and second bolts 112, 116 can be loosened for vertical and horizontal aiming, respectively. After the laser module 100 is aimed, the first and second bolts 112, 116 can be retightened.

FIG. 2 illustrates the rear of the laser module 100. As shown, the housing 102 includes a mil spec connector 120 for connecting the laser module 100 to a cable connected to a control panel (described below). The housing 102 also includes a purge valve 122 for purging the housing during maintenance. The pneumatic air release module 106 includes a pneumatic hose connector 124. In some embodiments, the pneumatic hose connector 124 is configured to connect to a pneumatic hose connected to a snowplow vehicle's secondary air source.

Figure 3:
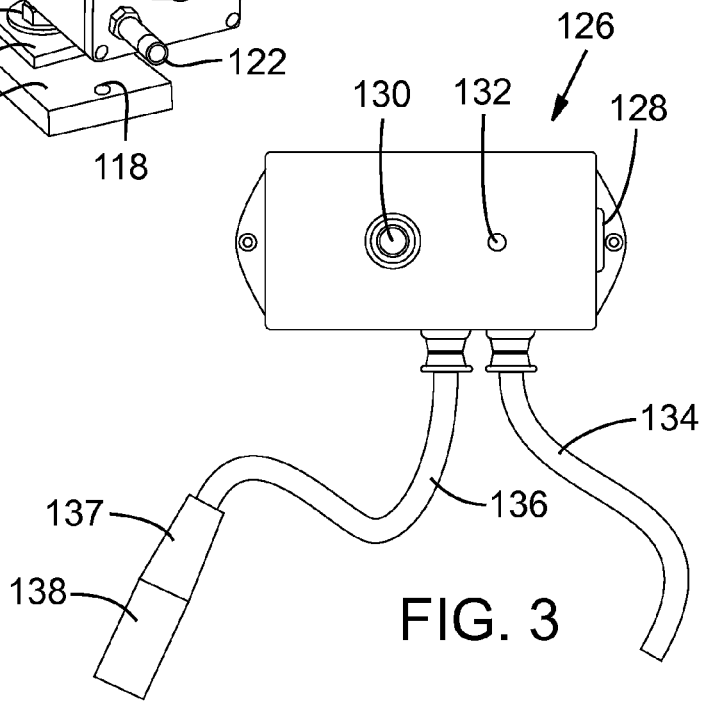
FIG. 3 is a plan view of one embodiment of a control module for use with some embodiments of the disclosed laser guidance system.

FIG. 3 illustrates an example of a control panel 126 for use with the laser module 100. The control panel 126 can be used, for example, in the cab of a snowplow vehicle. The control panel 126 includes a power button 128, a manual air release button 130, and an indicator light 132. The power button 128 can be pressed to activate the system. Embodiments including a green laser typically will start in a "preheat" mode to bring the system to its operating temperature. These systems can be configured to automatically activate the laser beam once the operating temperature has been reached. The indicator light 132 indicates the status of the laser. If the indicator light 132 is on, the laser is either in preheat mode or ready for use. If the indicator light 132 is off, the laser is off. The manual air release button 130 activates an on-demand air stream from the pneumatic air release module 106. A first cable 134 extending from the control panel 126 connects the system to a snowplow vehicle's power source (e.g., a 12V or 24V DC power source). A second cable 136 connects the control panel 126 to the laser module 100. In the illustrated embodiment, the second cable 136 includes a quick disconnect plug 137 and a mil spec connector 138 corresponding to the mil spec connector 120 of the laser module 100.

Figure 4:
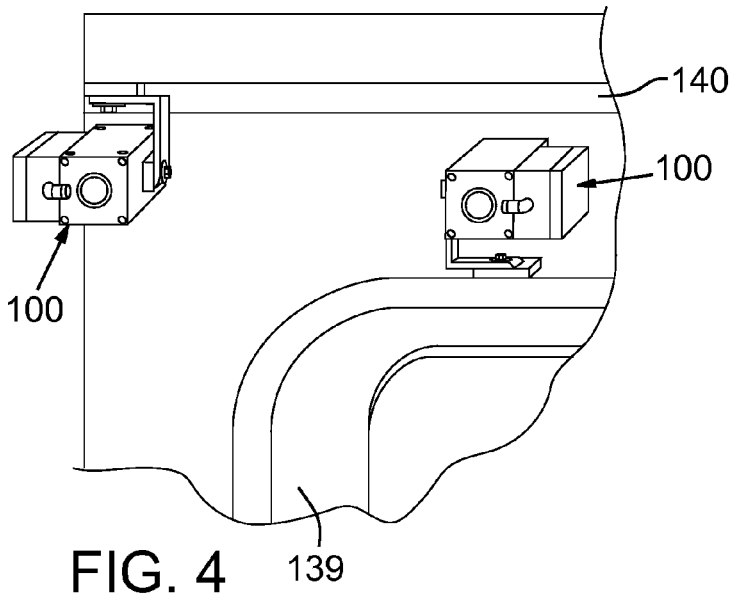
FIG. 4 is a perspective view of the laser module shown in FIG. 1 mounted to a snowplow vehicle in two different positions.
Figure 5:
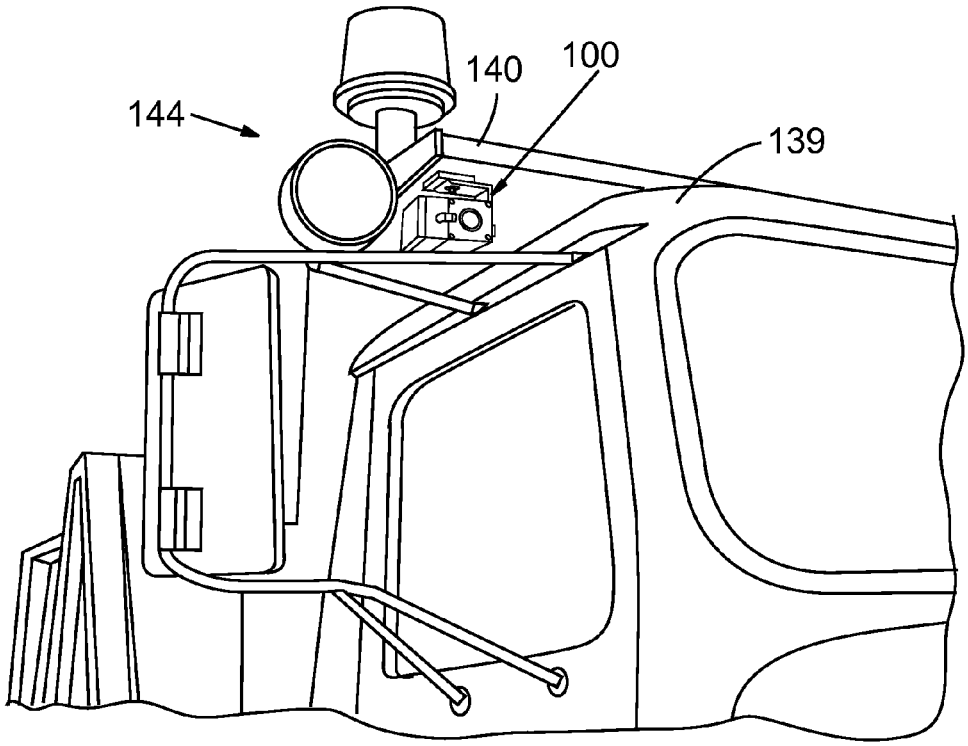
FIG. 5 is a perspective view of the laser module shown in FIG. 1 mounted below a snowplow vehicle's headache rack.

FIGS. 4 and 5 illustrate some examples of mounting positions for the laser module 100. The laser module 100 typically is mounted to a stable surface. If the laser base is vibrating, the vibration can be magnified at the projected point and can make it difficult to see. As shown in FIG. 4, the laser module 100 can be mounted on the passenger side of the snowplow vehicle 144, such as above the cab 139 or below the headache rack 140. FIG. 5 shows another example of the laser module 100 mounted below the headache rack 140 of a snowplow vehicle 144.

Figure 6:
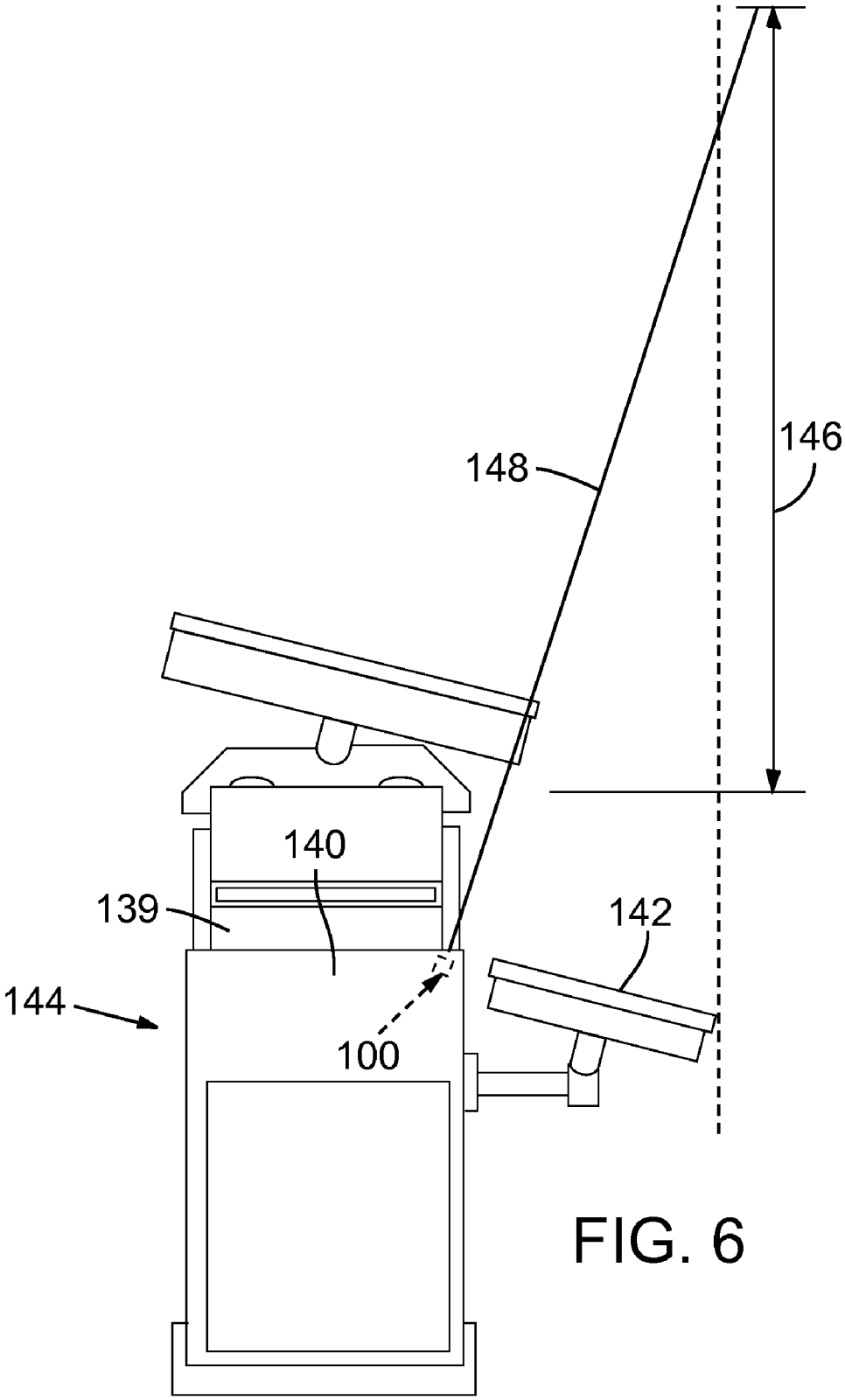
FIG. 6 is a plan view of the laser module shown in FIG. 1 mounted to a snowplow vehicle and projecting a laser beam.

FIG. 6 illustrates aiming the laser module 100. In one exemplary aiming procedure, with a wing plow blade 142 of a snowplow vehicle 144 in the down position, a forward distance 146 is measured in-line with the outside edges of the front and rear outside tires. This distance can be any distance far enough in front of the snowplow vehicle 144 to make a point projected by a laser beam 148 visible to an operator, such as between about 20 feet and about 100 feet or between about 40 feet and about 80 feet. The proper distance depends on the anticipated driving conditions. Typically, the front wheels are straight during this measurement and the measurement is done on a flat surface or continuous slope running fore and aft of the snowplow vehicle 144. From the measured point, the laser beam 148 can be aimed to the right a distance equal to the width of the wing plow blade 142 (which typically is about 8 feet). In some cases, a small distance is added to act as a cushion, e.g., about 6 to 24 inches. Once the laser beam 148 is aimed, the housing 102 can be locked down securely using the first and second adjustment bolts 112, 116 (FIGS. 1 and 2).

Figure 7A:
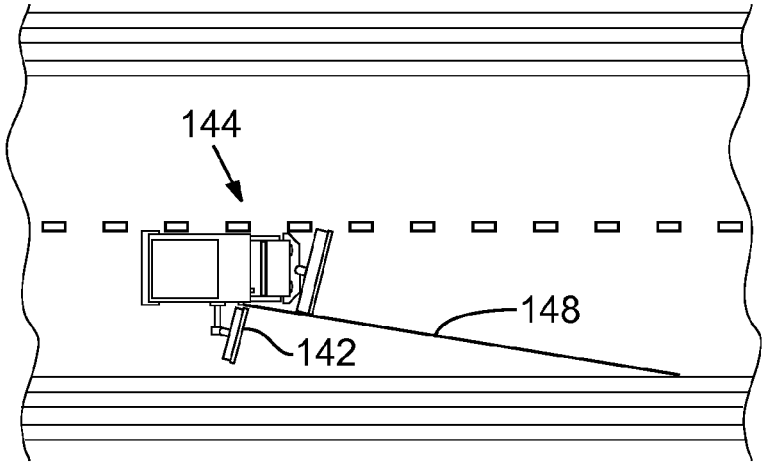
FIG. 7A is a plan view showing the path of a laser beam projected from the laser module shown in FIG. 1 mounted to a snowplow vehicle as the snowplow moves along a straight path.
Figure 7B:
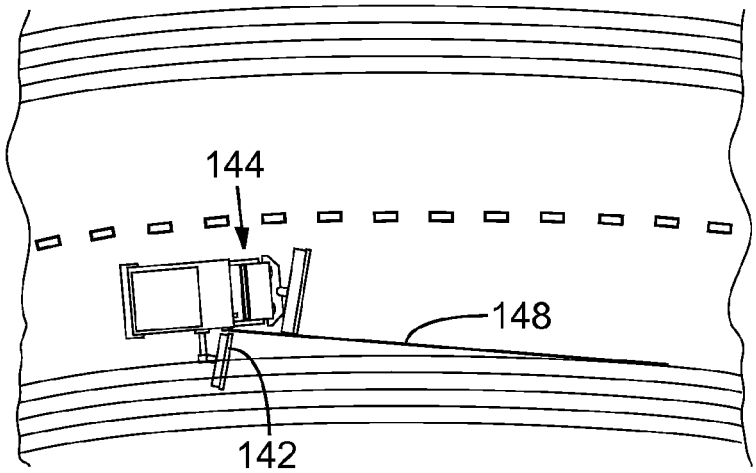
FIG. 7B is a plan view showing the path of a laser beam projected from the laser module shown in FIG. 1 mounted to a snowplow vehicle as the snowplow moves along a path that curves to the right.
Figure 7C:
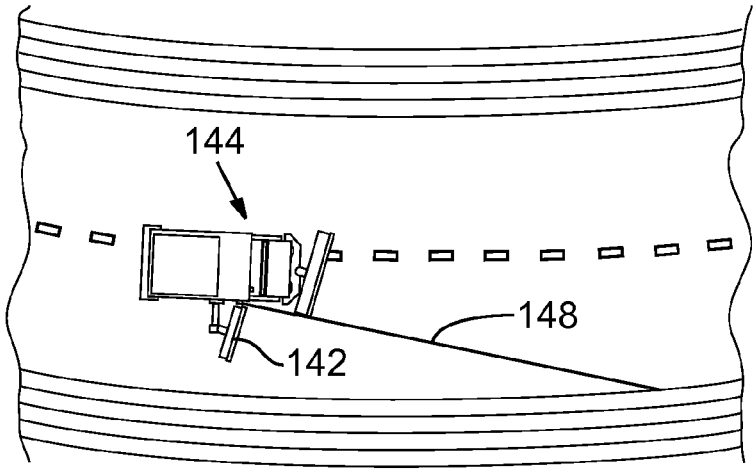
FIG. 7C is a plan view showing the path of a laser beam projected from the laser module shown in FIG. 1 mounted to a snowplow vehicle as the snowplow moves along a path that curves to the left.

FIGS. 7A-7C illustrate operation of one embodiment of the disclosed laser guidance system. As shown in FIG. 7A, the position of the point projected by the laser beam 148 is an accurate indicator of the future position of the outside edge of the wing plow blade 142 when the road is straight. When the road curves right (FIG. 7B), the trailing edge of the wing plow blade 142 will have less room than indicated. When the road curves left (FIG. 7C), the trailing edge of the wing plow blade 142 will have more room than indicated. To more accurately reflect the future position of the trailing edge of the wing plow blade 142, some embodiments include a laser module 100 that adjusts its position as the snowplow vehicle 144 moves. For example, the laser module 100 can be attached to a mechanical actuator that adjusts the path of the laser beam 148 in response to a signal from the snowplow vehicle 144. The signal can be generated, for example, by turning the steering wheel.

Embodiments of the disclosed laser system can include several electrical components. Some embodiments include an embedded microprocessor to monitor and control system functions. This increases reliability, reduces the parts count, and facilitates assembly and adjustment. In addition to multiple safeguards programmed into the microprocessor, protection against faulty operation can be provided by an electronic current limit for the laser diode and a watchdog timer to reset the microprocessor if the program becomes nonresponsive. The laser system can be protected against electrical damage, for example, by use of a self-resetting circuit breaker, reverse polarity protection, and/or transient overvoltage.

The microprocessor can be configured to monitor and control laser temperature quickly and precisely under differing conditions using a closed loop PID (proportional, integral, differential) feedback software routine. A thermistor can be used as a temperature sensor. Temperature control can be provided by a resistive preheater driven with multiple power levels, such as up to 128 power levels. The PID routine can run at a regular interval to maintain the desired laser temperature. Each interval can be, for example, between about 1 second and about 10 seconds, between about 1 second and about 5 seconds, or between about 4 seconds and about 6 seconds. In working embodiments, the interval was about 3 seconds. In some embodiments, the desired laser temperature is about room temperature, such as about 23° C. The desired laser temperature can be maintained within a specific tolerance, such as a tolerance between about 0.1° C. and about 2° C. over a broad ambient temperature range, such as from about −40° C. to about 10° C. In working embodiments, the tolerance was about 0.5° C.

Laser output power can be measured with a photodiode and tightly controlled using a high-resolution, digitally-controlled current source. This loop can be run, for example, 125 times per second and can be backed up with an electronic current limit to protect the laser diode against excessive current. Laser current can be ramped up slowly by the microprocessor to prevent transient damage to the laser diode. In some embodiments, the laser temperature is checked against lower and upper limits regularly, such as about 125 times per second. Laser operation can be inhibited if the temperature falls outside of an acceptable range, such as between about 20° C. and about 30° C.

In addition to the normal power and air release functions available to the operator when using the a control panel, such as the control panel 126 shown in FIG. 3, the laser system can include bidirectional half-duplex serial digital communications circuitry sharing the same three-wire cable. This can allow communication of digital data between the laser system and an external computer interface. Such communication can allow test and adjustment to be done during assembly, calibration, or repair without opening the sealed laser housing.

Almost any parameter can be read or adjusted through this interface, such as laser power, laser operating current, laser current limit, operating temperature, laser target temperature, laser temperature limits, air release timing, defrost temperature, serial number, fault conditions, and total operating time.

One example of an embodiment of the disclosed laser guidance system has the specifications recited in Table 1 below.

TABLE 1

| Exemplary System Specifications | |
|---|---|
| Laser | 532 nM Class IIIA |
| Power | 11-15 Volt DC Positive or Negative Ground |
| Power Draw | 4.00 Amps (Maximum Operating); 0.03 Amps (Standby Mode) |
| Pneumatic | 120 PSI/12 Volt Operation |
| Pneumatic Hose Length | 20 Feet |
| Shipping Weight | 25 Pounds |
| Recommended Ambient Operating Temperature | −40° C. to +10° C. |
| Recommended Ambient Storage Temperature | −40° C. to +65° C. |
| Laser Housing and Mount Height | 4.5 Inches |
| Laser Housing and Mount Length | 9 Inches |
| Laser Housing and Mount Width | 3.75 Inches-4.25 Inches with Bolt |
| Cable Length from Laser Housing to Control Panel | 20 Feet |
| 12 Volt Power Cable Length from Control Panel | 5 Feet |

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A laser guidance system, comprising:

a laser light source;

a laser exit window through which a laser beam generated by the laser light source is transmitted; and a gas cannon positioned such that gas ejected from the gas cannon flows across an outside surface of the laser exit window.

2. The laser guidance system according to claim 1, further comprising a pneumatic hose configured to connect the gas cannon to a pressurized air source of a vehicle.

3. The laser guidance system according to claim 1, wherein the gas cannon includes a nozzle and the position of the nozzle is adjustable.

4. The laser guidance system according to claim 1, wherein the gas cannon includes a valve and the laser guidance system further includes a controller programmed to automatically open and close the valve at a predetermined frequency.

5. The laser guidance system according to claim 1, wherein the gas cannon includes a valve and the laser guidance system further includes a control module with a switch configured to open the valve.

6. The laser guidance system according to claim 1, further comprising a heater connected to the laser exit window, wherein the heater is separate from the laser light source.

7. The laser guidance system according to claim 6, wherein the heater is a resistive heater.

8. The laser guidance system according to claim 6, further comprising a temperature gauge, wherein the laser guidance system is configured to send a signal to activate the heater when a temperature detected by the temperature gauge is less than a predetermined temperature.

9. The laser guidance system according to claim 8, wherein the temperature gauge is a thermistor sensor also used to control an operating temperature of the laser light source.

10. The laser guidance system according to claim 1, further comprising a wiper blade configured to wipe an outside surface of the laser exit window.

11. The snowplow system according to claim 1, wherein the laser light source is DC powered.

12. The snowplow system according to claim 1, further comprising a laser housing containing the laser light source and a bracket configured to mount the laser housing to a vehicle.

13. The snowplow system according to claim 12, wherein the laser housing is rotatable in a first plane, the laser housing and the bracket are rotatable in a second plane, and the first plane is substantially perpendicular to the second plane.

* * * * *